United States Patent [19]

Scalia

[11] Patent Number: 4,690,409

[45] Date of Patent: Sep. 1, 1987

[54] METHOD OF PLAYING A LETTER SELECTING AND ARRANGING GAME

[76] Inventor: Antonino Scalia, 5639 Raven Ct., Birmingham, Mich. 48010

[21] Appl. No.: 858,821

[22] Filed: Apr. 29, 1986

Related U.S. Application Data

[63] Continuation of Ser. No. 632,534, Jul. 29, 1984, abandoned.

[51] Int. Cl.[4] ..... A63F 1/00

[52] U.S. Cl. ..... 273/299; 273/141 R

[58] Field of Search ..... 273/272, 299, 144 R, 273/240

[56] References Cited

U.S. PATENT DOCUMENTS

| | | | |
|---|---|---|---|
| 2,676,019 | 4/1954 | Steinberg | 273/141 R |
| 3,195,895 | 7/1965 | Kropinski | 273/240 |
| 3,606,336 | 9/1971 | Krause | 273/272 |

FOREIGN PATENT DOCUMENTS

| | | | |
|---|---|---|---|
| 932685 | 12/1947 | France | 273/272 |

*Primary Examiner*—Anton O. Oechsle

*Attorney, Agent, or Firm*—Gifford, Groh, VanOphem, Sheridan, Sprinkle and Dolgorukov

[57] ABSTRACT

A game includes an indicator board having a pointer pivotally supported over a first dial face divided into sectors, each sector having indicia to identify an integer therein. The board also includes a pointer pivotally mounted over a second dial face having at least twenty six sectors, each sector including indicia to identify a letter of the alphabet. In addition, letter indicia members corresponding to the letters identified in the second dial piece are manipulated by a player to form abbreviations, acronyms, or initials. The method of practicing the game includes randomly selecting an integer on the first dial face to be used to determine the number of letters to be used during a player's turn, randomly selecting alphabetic letters on the second dial face to determine the particular letters to be used during a player's turn, and selecting corresponding indicia members which are then arranged and juxtapositioned to make abbreviations, acronyms or initials recognizable to the player. A score sheet is used as a means for recording point values for the number of letter indicia members employed during the course of a player's turn to successfully produce abbreviations, acronyms and initials.

1 Claim, 5 Drawing Figures

METHOD OF PLAYING A LETTER SELECTING AND ARRANGING GAME

This is a continuation of application Ser. No. 632,534, filed on July 29, 1984, and now abandoned.

BACKGROUND OF THE INVENTION

1. Field of the Present Invention

The present invention relates generally to games in which the letters of the alphabet are arranged to form readable designations, and more particularly to a game where the combination of letters available for use is randomly selected and in which abbreviations, acronyms and initials are formed from the letters in order to obtain a score value during each player's turn.

2. Description of the Prior Art

There are many previously known games which utilize letters of the alphabet and in which players are challenged to form words. Most such games test the vocabulary of the players, and players with an extremely large vocabulary have a decided advantage over players whose vocabulary is not as extensive. Thus, there is little incentive for players having substantially different vocabulary ranges, such as elementary school children and professional adults, to engage in competition with each other with these games.

Moreover, the previously known word games do not provide any credit to players for their knowledge of well known abbreviations, acronyms, or initials which may be well recognized within a particular culture. In view of the fact that the growth and use of language has necessitated the use of the number of abbreviations, acronyms and initials for identifying entities, events or places in as brief and as concise a manner as possible, the previously known word games are not well adapted for testing practical knowledge of many newsworthy or important people, events or organizations.

In addition, in some previously known word games, the players are provided with a limited number of randomly selected letters which often cannot be used to form recognizable or readily understood complete words. Such limitations can substantially restrict the players ability to form words which will advantageously increase his score during the game and can unduly inhibit the player's enjoyment of the game.

SUMMARY OF THE PRESENT INVENTION

The present invention overcomes the above-mentioned disadvantages by providing a method for playing a game in which the players construct abbreviations, acronyms and initials with a limited number of randomly selected letters. In general, an integer is randomly selected by a player during his turn, and the integer indicates the number of letters to be utilized during a player's turn. Letters are then randomly selected to provide the player with the particular letters to be used during his turn. During a player's turn, the letters are arranged by the player to form recognizable, commonly understood abbreviations, acronyms and initials, and scoring points are awarded for completion of the abbreviations, acronyms and initials.

In the preferred embodiment, a pointer is spun on a flat dial face to indicate an integer which identifies the number of letters to be selected during a player's turn. Furthermore, a pointer is spun on a second dial face to select the particular alphabetic letters to be used during a player's turn. Once the letters have been selected, the player arranges indicia members bearing indicia corresponding to the randomly selected letters in order to form an acronym, abbreviation or initial utilizing as many indicia members as possible. A predetermined value is awarded for each indicia member successfully used in forming a recognizable or commonly understood abbreviation, acronym or initial. Of course, after each player's turn, a score acquired during that turn is recorded with appropriate means such as a printed chart, electronic calculator, or the like.

Thus the present invention provides a game which tests the player's abilities to recognize commonly employed or readily recognizable abbreviations, acronyms and initials which can be learned in everyday life and which does not merely test the vocabulary of the player. Moreover since scoring points can be subtracted as well as added to a player's score, players of substantially different backgrounds can be competitive in the same manner as other games of chance. Moreover, substantially less equipment can be used to play the game than in many previously known word games.

BRIEF DESCRIPTION OF THE DRAWING

The present invention will be more clearly understood by reference to the following detailed description when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
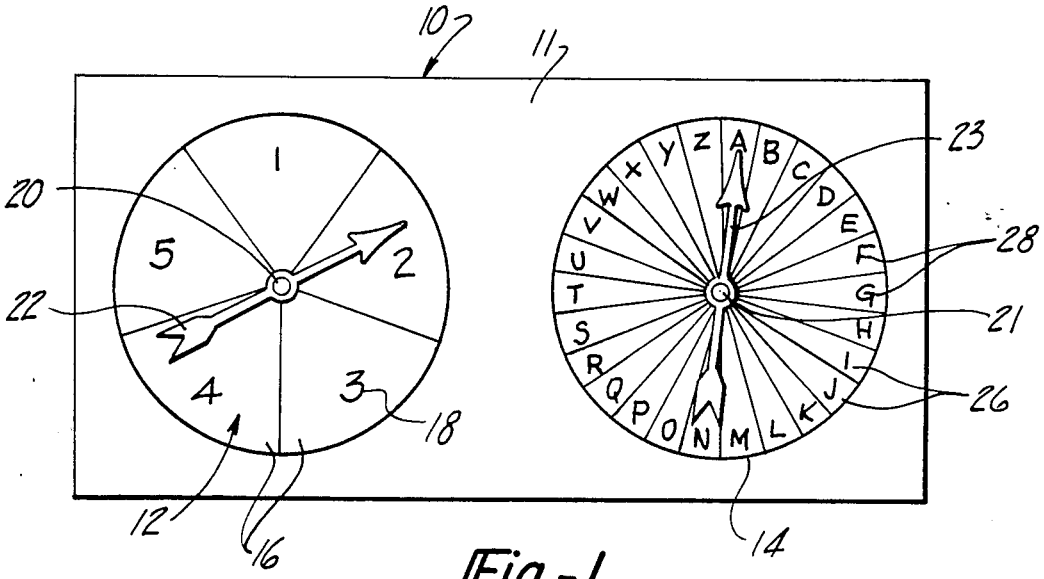
FIG. 1 is a plan view of a portion of the game apparatus for randomly selecting letters and numbers.

The method and apparatus used in practicing the game of the present invention is best described by reference to a specific detailed embodiment. Nevertheless, it is to be understood that the drawing and the detailed description are not limiting upon the scope of the present invention insofar as various method steps can be performed and various apparatus can be utilized in practicing the game of the present invention. For example, a means for randomly selecting numbers can be provided by dice or other chance means as well as the particular spinner apparatus 10 shown in the drawing. Similarly, alphabetic letters can be randomly selected from rotatable, lettered wheels having letter indicia which are designated by a fixed pointer when the wheel stops spinning or from a playing board upon which letters are printed and covered by removable panels, as well as the particular spinner indicator 10 shown in the drawing. Likewise, scorekeeping apparatus having means for adding and subtracting scores can be employed in the method of practicing the invention. Nevertheless, the apparatus shown in the drawing is especially advantageous for use in playing the game as will be discussed in greater detail hereinafter.

Referring first to FIG. 1, an indicator board 10 according to the present invention is thereshown comprising a base 11 having a first dial face 12 and a second dial face 14. The first dial face 12 is circular and includes five sectors 16 each including an imprinted integer indicia 18. As shown in FIG. 1, the numbers 1 through 5 are imprinted on the sections 16. The relative sizes and the number of sections 16 can be varied within the scope of the present invention, although the selection of integers utilized in the preferred embodiment is considered to provide a player with sufficient opportunity to increase his score by forming abbreviations, initials or acronyms without unduly complicating or prolonging the player's turn. The indicator base 11 supports a pivot stem 20 at the center of the dial face 12 for pivotally supporting a pointer 22 at its center.

Figure 2:
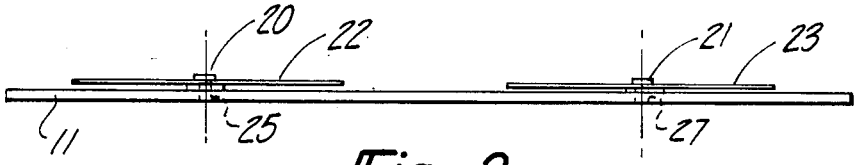
FIG. 2 is a side elevation view of the apparatus shown in FIG. 1.

The dial face 14 includes twenty-six sectors 26, each sector 26 including a letter 28. Although each sector 26 is shown of equal size, it is also within the scope of the present invention to vary the size of the sectors as desired. However, spacing of the sectors 26 as shown in FIG. 1 provides an even chance for any letter of the alphabet to be chosen during a player's turn. The base 11 also supports a second pivot stem 21 for pivotally securing a second pointer 23 at its center over the dial face 14. As best shown in FIG. 2, the pointers 22 and 23 are supported by the stems 20 and 21 respectively above the surface of the base 11 so that the pointers 22 and 23 can turn freely about the reduced diameter stem portions 25 and 27 of the stems 20 and 21 respectively without interference from the base 11 of the indicator board 10.

Referring now to FIG. 3 a plurality of letter indicia members 30 are thereshown as preferably comprising tile blocks 32, each tile block 32 including a letter indicia 34 on at least one face thereof. The letter indicia members 30 provide a means for physically rearranging and juxtapositioning the letters randomly selected by spinning the pointer 23 over the dial face 14, and aid in the recognition of abbreviations, acronyms and initials known to the player. Preferably, the game apparatus will include a plurality of indicia members 30 in a number which at least corresponds with the number of sectors 26 on the dial face 14. Moreover it is also within the scope of the present invention to provide multiple sets of the same letters so that any letter which has been repeatedly randomly selected during the player's turn can be made available to the player for arranging and juxtapositioning.

Figure 4:
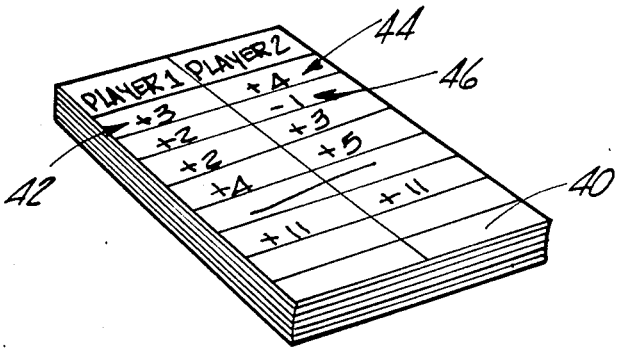
FIG. 4 is a plan view of a scoring chart for use in the game of the present invention.

FIG. 4 displays a scoring chart 40 for use in recording point values scored by a player during a turn. The features of the chart will be discussed in more detail hereinafter by way of example in the following discussion concerning a sample game played with the apparatus and method of the present invention.

In a game being played by two players, each player spins the pointer 22 over the dial face 12 once to determine which player is to start the game. For example, the player having spun the highest number can be the first player to play. After the starting order has been determined, the first player spins the pointer 22 over the dial face 12 to determine how many letters are to be made available for forming abbreviations, acronyms and initials during his turn. The pointer 23 on the dial face 14 is then spun the number of times indicated by the integer 18 identified on the sector 16. Each time the pointer 23 on the dial face 14 is spun, the letter at which it comes to rest is identified, and the corresponding alphabetic letter indicia member 30 is selected for use by the player. Upon completing the number of spins of the pointer 23 around the dial face 14, the alphabet letter indicia member 30 can be manipulated and arranged by the first player to form at least one abbreviation, initial or acronym, and utilizing as many of the selected indicia members 30 as possible. Of course, the player's turn can be limited to a particular duration, such as 15 seconds, in which to rearrange the letters to form one or more abbreviations, acronyms or initials for which points can be awarded. At least two indicia members 30 must be used for each acronym, abbreviation or initial formed.

Figure 3A:
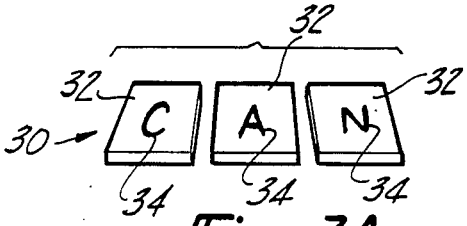
FIGS. 3A and B are perspective views of indicia members for use in the game of the present invention.

Scoring points can be awarded for the number of indicia members 30 utilized to form abbreviations, acronyms or initials during a player's turn. For example, a player could accumulate one point for each alphabetic letter indicia member 30 successfully utilized in the formation of an abbreviation, acronym or initial. As shown at 42 in FIG. 4, the first player having randomly selected letters A, C and N, and having arranged them to form an abbreviation for the word Canada, as shown in FIG. 3A, would score, for example, 3 points which would then be recorded on the score sheet 40.

Figure 3B:
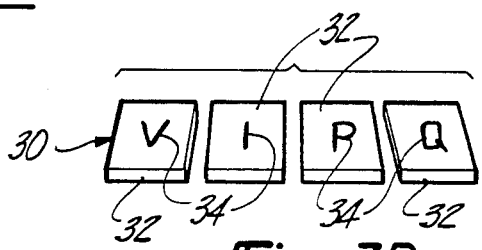

The second player would then spin the pointer 22 on dial face 12 to determine the number of alphabetic letters to be used during the second player's turn. The pointer 23 on dial face 14 is then spun the requisite number of times in order to identify the alphabetic letters to be used during his turn. Once the letters have been selected, corresponding letter indicia members 30 can be manipulated and arranged by the second player to form abbreviations, acronyms and initials. As exemplified on the drawing, the second player could randomly select the number 4 on dial face 12, and thereafter receive the letters V, I, P and Q on dial face 14. As shown in FIG. 3B, the player could select corresponding indicia members 30 and arrange them to form the combination of the letters V, I, and P to form the acronym for Very Important Person, thereby omitting to put letter Q with the remaining initials. In such case, the second player would score only 3 points for having used 3 indicia members and that score would be recorded on score sheet 40 as shown in FIG. 4.

Moreover, whenever a player has spun the pointer 22 on dial face 12 and, as a result the pointer 22 comes to rest at the sector including the integer 1, a predetermined point value is detracted from that player's score and the player's turn has ended. As shown at 46 in FIG. 4, the second player has subtracted a score value of one since a single initial cannot be used to add points to a player's score, but rather causes a reduction in the score of that player.

Thus the present invention provides a game which employs a player's practical knowledge of abbreviations, acronyms and initials and which at the same time employs the element of chance so that the game can be competitively played between players of different educational backgrounds. In addition, the game is simple to produce and use and thus avoids the substantial cost of many previously known word game apparatus. Since both the number of letters and the particular letters used during each player's turn are randomly selected, the game of the present invention provides many hours of enjoyment because the number of possibilities for abbreviations, acronyms and initials can cover a wide range of fields, subjects and events of public interest.

Having thus described my invention, many modifications thereto will become apparent to those skilled in the art to which it pertains without departing from the scope and spirit of the present invention as defined in the appended claims.

What is claimed is:

1. A method for playing a game comprising:

(a) spinning a first pointer pivotally secured to a first dial having a sectored face with an integer in each sector to randomly select one integer from a set of a plurality of integers;

(b) spinning a second pointer pivotally secured to a second dial having a sectored face with an alphabetic letter indicia in each sector to randomly individually select a plurality of letters of the alphabet when said integer is greater than 1, wherein the number of said plurality of individual letters corresponds to the value of said integer and wherein the probability of selecting any letter remains constant throughout the play of the game;

(c) selecting letter indicia members, each member selected having indicia designating a letter corresponding to the letters selected in step (b); and (d) arranging said at least two letter indicia members to form an identifiable abbreviation, initial or acronym;

(e) recording a predetermined positive score value for each indicia member used in the abbreviation, initial or acronym;

(f) recording a negative score value whenever the selected integer from said first step equals a predetermined value;

(g) maintaining a recorded total score for each player until the total score for any player exceeds a predetermined amount.

* * * * *